US006398944B1

(12) United States Patent
Arlt et al.

(10) Patent No.: US 6,398,944 B1
(45) Date of Patent: Jun. 4, 2002

(54) METHOD OF REMOVING ACID FORMED DURING CATHODIC ELECTRODIP COATING

(75) Inventors: Klaus Arlt, Senden; Udo Heil, Bönen; Karl-Heinz Grosse-Brinkhaus, Nottuln, all of (DE)

(73) Assignee: BASF Coatings AG, Glasuritstrasse (DE)

( * ) Notice: Subject to any disclaimer, the term of this patent is extended or adjusted under 35 U.S.C. 154(b) by 0 days.

(21) Appl. No.: 09/043,369

(22) PCT Filed: Sep. 2, 1996

(86) PCT No.: PCT/EP96/03845

§ 371 (c)(1),
(2), (4) Date: May 19, 1998

(87) PCT Pub. No.: WO97/11211

PCT Pub. Date: Mar. 27, 1997

(30) Foreign Application Priority Data

Sep. 18, 1995 (DE) ..... 195 34 534

(51) Int. Cl.[7] ..... C25F 7/02; C25D 13/24
(52) U.S. Cl. ..... 205/688; 204/480; 204/482
(58) Field of Search ..... 204/96, 149, 181, 204/232, 238, 288, 299, DIG. 13, 480, 482, 290 R, 290 F; 205/138, 413, 688, 99, 101

(56) References Cited

U.S. PATENT DOCUMENTS

| | | | | |
|---|---|---|---|---|
| 3,682,814 A | 8/1972 | Gilehrist | | |
| 4,879,013 A | 11/1989 | Austin | | |
| 4,971,672 A | 11/1990 | Voss et al. | ..... | 204/182.4 |
| 5,091,071 A | 2/1992 | Voss et al. | ..... | 204/182.4 |

FOREIGN PATENT DOCUMENTS

| | | | | |
|---|---|---|---|---|
| DE | 15 71 721 | 5/1966 | ..... | C25B/11/10 |
| DE | 1 671 422 | 2/1968 | ..... | B01K/3/06 |
| DE | 34 23 605 A1 | 6/1984 | ..... | C25B/11/06 |
| DE | 44 09 270 C1 | 3/1994 | ..... | C25D/13/06 |
| EP | 0 296 167 B1 | 2/1987 | ..... | C25D/13/22 |

OTHER PUBLICATIONS

Stucki, Kötz, Carcer, Suter: "Electrochemical waste water treatment using high overvoltage anodes, Part II: Ahode performance and applications" Journal of Applied Electrochemistry 21, 2/91, pp. 99–104.

Christos Comninellis, "Electrochemical Treatment of Waste Water Containing Phenol", Electrochemical Engineering and the Environment 92, Symposium Series No. 127, pp. 189–201.

Grant and Hackh's Chemical Dictionary, Fifth edition (p. 277), No date available/1987.*

* cited by examiner

*Primary Examiner*—Kathryn Gorgos
*Assistant Examiner*—Thao Tran

(57) ABSTRACT

A method of removing, by oxidation at the anode, the acid liberated in cathodic dip-coating in the course of the deposition of the coating film, using anodes coated with a layer of tin oxide or with a mixture of tin oxide with ruthenium or iridium oxides.

15 Claims, 1 Drawing Sheet

METHOD OF REMOVING ACID FORMED DURING CATHODIC ELECTRODIP COATING

The present invention relates to a method of removing the acid liberated from the electrodeposition bath in cathodic electrodeposition coating while the coating film is being deposited.

BACKGROUND OF THE INVENTION

In cathodic electrodeposition coating, the substrate to be coated is immersed in an aqueous electrodeposition bath and connected as the cathode. When a voltage is applied, a coating film is deposited on the substrate. The coating materials employed comprise polymers that have been converted by protonation to a water-dispersible form. This protonation is achieved predominantly through the addition of weak organic acids. These acids accumulate in the region of the anode if in the course of coating deposition the cationic binder is neutralized and the coating material that has been consumed is gradually replaced by new, protonated coating material. In order to control the pH of the electrodeposition bath, therefore, it is necessary to remove the acid from the bath. This is generally done by means of what is known as the anolyte circuit. The anolyte circuit initially requires that the anode is separated from the remainder of the electro-deposition bath by a diaphragm or membrane. This membrane is generally an anion exchange membrane, which permits only anions—in the present case, acid radicals—to flow toward the anode. Binders and pigments, on the other hand, are held back. By means of the anolyte circuit, acid-enriched electrolyte is withdrawn from the anode compartment, discarded generally as wastewater, and replaced by water.

In addition to the anolyte circuit, electrodeposition baths normally include an ultrafiltration circuit. This circuit removes bath liquid directly and passes it to an ultrafiltration stage whose purpose is to separate out solvents and other coating components of low molecular mass that accumulate in the bath. Binders and pigments, on the other hand, are retained and passed back to the bath. For further details regarding the prior art reference may be made to the literature (e.g. "farbe+lack", 2/1981, p. 94 ff).

For removing the acid which accumulates in the bath U.S. Pat. No. 3,682,814 proposes breaking down at least part of this acid by oxidation at the anode. Auxiliary measures are considered here for effective implementation of the oxidation, such as the heating of the anode zone or the addition of a catalyst solution. It is additionally intended that anodes by used which are coated with platinum, platinum oxide and other noble metals, chromates, manganates, vanadates, molybdates, cobalt, nickel, chromium and oxides of these metals, and other heavy metals. The acid to which U.S. Pat. No. 3,682,814 gives particular preference in its procedure is formic acid. The reason for this is that the oxidative dissociation of formic acid to carbon dioxide and water consumes two charge units per dissociated molecule. The acid in the bath can therefore be broken down electrochemically with a theoretical maximum of 50%. Other common electrocoating bath acids require more charge units per molecule for their anodic oxidation to carbon dioxide and water, and therefore have even lower theoretical maximums.

Using the process specified in U.S. Pat. No. 3,682,814 it is possible according to Example 1 therein to break down about 40%—out of a theoretical maximum possible 50%—of the formic acid neutralized at the anode. A disadvantage of this process is the instability of the anodes employed. In addition, anode and cathode are separated by a membrane, since the temperatures and pH for a particularly efficient reaction in the anode compartment are different than those prevailing in the cathode compartment.

DE-44 09 270 also proposes anodic oxidation of the acid employed. As already preferred in U.S. Pat. No. 3,682,814 the acid employed here is again essentially—in other words, to an extent of more than 90%—formic acid. Theoretically possible anode materials specified are platinum and platinized stainless steel electrodes, platinized titanium electrodes, platinized graphite electrodes, ruthenium-doped stainless steel electrodes or mixed-oxide-doped electrodes made from stainless steel, titanium or graphite. Unlike U.S. Pat. No. 3,682,814, however, this patent gives no measurement results and no numerical data for the breakdown rates achieved.

With regard to the electrodes that can be employed in electrochemical processes, German Patent 15 71 721 discloses electrodes that are employed inter alia as anodes for the chloralkali electrolysis. To avoid losses and improve electrode resistance, use is made of oxides of platinum, iridium, rhodium, palladium, ruthenium, manganese, lead, chromium, cobalt, iron, titanium, tantalum, zirconium or of silicon. Further fields of use of said electrodes are in electrodialysis and electrodeposition coating.

German Patent 16 71 422, furthermore, discloses the use in the alkali metal chloride electrolysis of an anode comprising a titanium core with a mixed coating covering at least part of the core surface and comprising a material formed from ruthenium oxide and titanium oxide which is resistant to the electrolytes and to the electrolysis products. These anodes exhibit a substantially lower degree of overvoltage and at the same time are dimensionally stable. Building on these properties it was possible to develop cell constructions, such as membrane cells, and hence to improve the performance of the mercury cells and diaphragm cells known hitherto.

DE-A 34 23 605 describes composite electrodes comprising an electroconductive polymer and, embedded partly therein, catalytic particles (support particles with applied catalyst) and processes for their preparation. They can be employed, for example, as an oxygen anode in the electrolytic recovery of metals from aqueous solutions. Further fields of use that are specified are electrodialysis and electrodeposition coating.

EP-B 0 296 167 likewise describes the use of comparable electrodes (referred to as dimensionally stable anodes, DSA) in cathodic electrodeposition coating. These electrodes are neither dissolved nor destroyed in the course of electrophoretic coating under the electrodeposition conditions assumed therein, i.e. in respect of coating formulation, current density, pH and the destructuve influence of chlorine.

In the field of wastewater treatment, as well, various electrodes have been tested and employed for the oxidative breakdown of substances. In the course of such tests and use it has been found, in particular, that electrodes with a coating of tin oxide ($SnO_2$) are highly effective in the electrochemical breakdown of organic substances. These electrodes have in particular also been tested in comparison with conventional electrodes such as the abovementioned DSA electrodes, for example (Stucki, Kötz, Carcer, Suter: "Electrochemical waste water treatment using high overvoltage anodes, Part II: Ahode performance and applications", Journal of Applied Electrochemistry 21 (1991), 99–104; Comnimellis: "Traitement des eaux résiduaires par voie électrochimique", gwa 11/92, 792–797; Comninellis: "Electrochemical treatment of waste water containing phenol", Electrochemical Engineering and the Environment 92, Symposium Series No. 127, 189–201).

SUMMARY OF THE INVENTION

The present invention has now set itself the object of providing a method of removing the acid liberated in cathodic electrodepostion coating in the course of the deposition of the coating film which reduces the number of rinsing procedures via the anolyte circuit that are required to remove acid and possible breakdown products of the acid or which manages completely without the anolyte circuit.

This object has surprisingly been achieved by removing the liberated acid, preferably formic acid, by oxidation at anodes coated with a layer of ruthenium oxide, iridium oxide or tin oxide or with a mixture of these oxides. With the procedure of the invention is has been possible to break down, oxidation, more than 49% of the acid in the bath. This comes close to the theoretical maximum of 50% and is a considerable improvement on the levels of around 40% specified in U.S. Pat. No. 3,682,814. Such increased efficiency makes it possible to reduce the number of flushing procedures required to remove the acid via the anolyte circuit. Furthermore, the electrodes employed by the invention are more chemically stable toward the medium.

It is also possible in accordance with the invention to employ acids other than formic acid. Such acids, however, and generally less favorable owing to their lower theoretical maximum capacity for electrochemical breakdown. Lactic acid, for instance, can be broken down electrochemically only to an extent of about 35%.

Surprisingly, it is even possible to do entirely without the anolyte circuit; in other words, the electrodes of the invention can be employed directly in the electrodeposition bath and it is no longer necessary to separate the anode from the cathode compartment by a membrane. In this case, the invention employs additional methods to reduce the acid content. These methods preferably comprise conventional membrane methods. These methods preferably begin with the ultrafiltrate, since the latter is already devoid of the relatively high molecular mass constituents of the coating material. Examples of suitable membrane methods are methods operating by means of dialysis, osmosis, reverse osmosis, electrodialysis or a further downstream ultrafiltration. Methods of this kind are described, for example, in DE-44 09 270, EP-262 419, U.S. Pat. No. 4,971,672 or U.S. Pat. No. 5,091,071.

As demonstrated by Example 2 below, it is possible under these conditions—i.e. without the anolyte circuit—to remove about 65–70% of the acid from the bath. The remaining 30–35% of acid can be expelled by means of a membrane method, e.g. electrodialysis. The use of such additional measures is of course also possible in baths operating with an anolyte circuit.

DETAILED DESCRIPTION OF THE PREFERRED EMBODIMENT

In the method of the invention the electrodeposition coating baths preferably employed are those whose binders comprise synthetic resins that have cationic groups. These binders are preferably protonated reaction products of epoxide-functional synthetic resins and amines. Protonation here preferably involves formic acid, acetic acid, lactic acid and dimethylolpropionic acid. Special preference is given to the use of formic acid. These acids are oxidized at the anode into water and carbon dioxide.

The substrate of the electrodes of the invention can consist of metal or conductive plastic. In the case of the metals it preferably comprises titanium, tantalum, niobium or an alloy of these metals. A suitable example is an alloy of titanium and from 1 to 15% by weight molybdenum. A particularly preferred substrate is titanium.

The layer of ruthenium, iridium or tin oxide, or of a mixture of these oxides, that is applied to the anodes employed in accordance with the invention preferably has a thickness of from 0.01 to 10 $\mu$m. A particularly preferred range is 0.1–7 $\mu$m.

The text below describes experimental examples with the method of the invention, demonstrating especially the improvements over the prior art.

EXAMPLE 1

Efficiency of the Anodic Breakdown of Formic Acid as a Function of the Electrode Material In a rectangular vessel (L×W×H=20×10×20 cm) fitted with a stainless steel cathode, 2.5 l of an aqueous formic acid solution (approximately 0.2 mol/l) were oxidized with different anode materials. The current density was 5 mA/cm$_2$, with an electrolyte temperature of 25–30° C. After each 0.2 F/mol step (based on formic acid), the acid content was determined by potentiometry. After 1 F/mol the experiment was terminated, and the acid breakdown and current yield, or efficiency, of the anodic oxidation of acid were determined.

$$\text{Acid breakdown} = (c_o - c_t)/c_o$$

$c_o$=concentration of acid prior to experiment $c_t$=concentration of acid at time $t$ of sampling or after the end of the experiment In determining the current yield (efficiency), the theoretically required charge consumption of 2 F/mol of acid is taken into account for the conversion of the formic acid to $CO_2$:

Efficiency=$(c_o-c_t)/co * Q_o/Q_t$ $Q_o$=theoretical charge consumption, i.e. 2 F/mol $Q_t$=actual charge consumption The anodes employed (each 10×10 cm) were as follows:

a. stainless steel (1.4401)

b. $RuO_2$-coated titanium plate c. $IrO_2$-coated titanium plate d. $SnO_2$-coated titanium plate The table which follows shows the results of the measurements. From this table it is evident that the anodes of the invention achieve an efficiency of from 93.7 to 98.8%, as compared with 86.9% for conventional stainless steel electrodes.

With values from 48.2 to 49.2%, the amount of acid broken down electrochemically almost reaches the theoretical maximum of 50%.

Table for Example 1

| | Electrode type | | | | | | | | | | | |
|---|---|---|---|---|---|---|---|---|---|---|---|---|
| | Stainless steel (1.440I) | | | $RuO_2$ | | | $IrO_2$ | | | $SnO_2$ | | |
| Charge consumption [F/mol] | Acid content (mol/l) | Acid breakdown % | Efficiency % | Acid content (mol/l) | Acid breakdown % | Efficiency % | Acid content (mol/l) | Acid breakdown % | Efficiency % | Acid content (mol/l) | Acid breakdown % | Efficiency % |
| 0.0 | 0.198 | | | 0.199 | | | 0.199 | | | 0.198 | | |
| 0.2 | 0.181 | 8.6 | 85.9 | 0.178 | 10.6 | 105.5 | 0.181 | 9.0 | 90.5 | 0.181 | 8.6 | 85.9 |
| 0.4 | 0.165 | 16.7 | 83.3 | 0.16 | 19.6 | 98.0 | 0.16 | 19.6 | 98.0 | 0.161 | 18.7 | 93.4 |
| 0.5 | 0.146 | 26.3 | 87.5 | 0.141 | 29.1 | 97.2 | 0.139 | 30.2 | 100.5 | 0.14 | 29.3 | 97.6 |
| 0.8 | 0.127 | 35.9 | 89.6 | 0.122 | 38.7 | 96.7 | 0.118 | 40.7 | 101.8 | 0.123 | 37.9 | 94.7 |
| 1.0 | 0.111 | 43.9 | 87.9 | 0.103 | 48.2 | 96.5 | 0.101 | 49.2 | 98.5 | 0.102 | 48.5 | 97.0 |
| Average efficiency | | | 86.9 | | | 98.8 | | | 97.8 | | | 93.7 |

EXAMPLE 2

Experiment on Acid Breakdown in a Semiautomatic Electrodeposition Coating Unit (Plate Coater)

Electrodeposition Coating Material:

A. Binder Dispersion (cf. EP 074 634, Example C, but Neutralized with Formic Acid)

The example that follows shows the preparation of a cationic resin that is neutralized by formic acid. Bisphenol A, bisphenol A diglycidyl ether and a bisphenol A/ethylene oxide adduct are heated together and form a modified polyepoxy resin. A blocked isocyanate is added as crosslinker to this resin. The product is then reacted with a mixture of secondary amines. The resin is partly neutralized with formic acid and is dispersed in water.

| Starting materials | Parts by weight |
|---|---|
| Epikote 828[1] | 682.44 |
| Bisphenol A | 198.36 |
| Dianol 265[2] | 252.70 |
| Methyl isobutyl ketone | 59.66 |
| Benzyldimethylamine | 3.67 |
| Blocked isocyanate[3] | 1011.28 |

-continued

| Starting materials | Parts by weight |
|---|---|
| Diketimine[4] | 65.41 |
| Methylethanolamine | 59.65 |
| 1-Phenoxy-2-propanol | 64.77 |
| Formic acid 85% | 32.92 |
| Emulsifier mixture[5] | 15.217 |
| Demineralized water | 3026.63 |

[1]Liquid epoxy resin prepared by reacting bisphenol A and epichlorohydrin, having an epoxide equivalent weight of 188 (manufacturer: Shell Chemicals)

[2]Ethoxylated bisphenol A having an OH number of 222 (manufacturer: Akzo)

[3]Polyurethane crosslinker prepared from diphenylmethane diisocyanate, where of 6 mols of isocyanate 4.3 are reacted first with butyldiglycol and the remaining 1.7 mol with trimethylolpropane. The crosslinker is in the form of an 80% strength solution in methyl isobutyl ketone and isobutanol (9:1 by weight).

[4]Diketimine formed from the reaction of diethylenetriamine and methyl isobutyl ketone, 75% strength in methyl isobutyl ketone -continued

| Starting materials | Parts by weight |
|---|---|

[5]Mixture of 1 part of butyl glycol and 1 part of a tertiary acetylene glycol (Surfynol 104, manufacturer: Air Products)

Epikote 828, bisphenol A and Dianol 265 are heated to 130° C. in a reactor with nitrogen blanketing. Then 1.6 parts of the benzyldimethylamine (catalyst) are added, the reaction mixture is heated to 150° C. and maintained at between 150 and 190° C. for about half an hour, and then cooled to 140° C. Subsequently, the remaining benzyldimethylamine is added and the temperature is held at 140° C. until, after about 2.5 h, an epoxide equivalent weight of 1120 is established. Directly thereafter, the polyurethane crosslinker is added and the temperature is lowered to 100° C. The mixture of the secondary amines is added subsequently, and the reaction is maintained at 115° C. for about 1 h until a viscosity of about 6 dPas is reached (50% dilution in methoxypropanol, ICI cone and plate viscometer). Following the addition of phenoxypropanol the resin is dispersed in the water in which the formic acid and emulsifier mixture have been dissolved.

The solids content after this step is 35%, and rises to 37% after the low-boiling solvents have been stripped off. The dispersion is characterized by a particle size of about 150 nm.

Grinding Resin (cf. EP 505 445, Example: Grinding Resin A3)

A reactor equipped with stirrer, internal thermometer, nitrogen inlet and water separator with reflux condenser is charged with 30.29 parts of an epoxy resin based on bisphenol A and having an epoxide equivalent weight (EEW) of 188, and with 9.18 parts of bisphenol A, 7.04 parts of dodecylphenol and 2.37 parts of butyl glycol. This initial charge is heated to 110° C., 1.7 parts of xylene are added, and the xylene is distilled off again under a weak vacuum together with any possible traces of water. Then 0.07 part of triphenylphosphine are added and the mixture is heated to 130° C. After an exothermic heat rise to 150° C., reaction is continued at 130° C. for 1 h. The EEW of the reaction mixture is then 860. The mixture is then cooled, during which 9.91 parts of butyl glycol and 17.88 parts of a propylene glycol diglycidyl ether with an EEW of 333 (DER 732, Dow Chemical) are added. At 90° C., 4.23 parts of 2-(2'-anilinoethoxy) ethanol and, 10 minutes later, 1.37 parts of N,N-dimethylaminopropylamine are added. After a short period of exothermicity the reaction mixture is held at 90° C. for 2 h more until the viscosity remains constant, and is then diluted with 17.66 parts of butyl glycol. The resin has a solids content of 69.8% (measured at 130° C. for 1 h) and a viscosity of 5.5 dPas (40% strength in Solvenon PM; cone and plate viscometer at 23° C.). The base content is 0.88 meq/g of solid resin (meq=milliequivalent=mmol of acid or base).

C. Pigment Paste (cf. EP 505 445, Example: Pigment Paste B 3, but Neutralized with Formic Acid)

To prepare the pigment paste a premix was first formed from 34.34 parts of deionized water, 0.38 part of formic acid (85% strength) and 18.5 parts of grinding resin. Then 0.5 part of carbon black, 6.75 parts of extender (ASP 200), 37.28 parts of titanium dioxide (R 900) and 2.25 parts of crosslinking catalyst (DBTO) are added and the constituents are mixed for 30 minutes in a high-speed dissolver stirrer. The mixture is then dispersed to a Hegman fineness of less than 12 for 1 to 1.5 h in a laboratory ball mill and adjusted with further water, if necessary, to the desired processing viscosity.

D. Electrodeposition Coating Material

For the cathodic electrodeposition coating material, 36.81 parts of the binder dispersion A are diluted with 52.5 parts of deionized water, and 10.69 parts of pigment paste C are introduced into this mixture with stirring. The coating material has a solids content of about 20% with an ash content of 25%.

The plate coater, equipped with pump circulation, temperature regulation unit, an attached ultrafiltration unit, but without separate anolyte circuit, is filled with 8 l of the above-described electrodeposition coating material.

The anode used is a titanium electrode (measuring 10×10 cm), coated with iridium oxide, which is immersed directly into the electrodeposition coating material.

In the coater, steel panels (measuring about 10×20 cm) are coated automatically for 2 minutes at 280 V and at 28° C. The coat thickness is about 20 $\mu$m. After coating, the panels are dipped in the ultrafiltrate in order to rinse off adhering coating material and thereby pass it back to the dip tank.

After each 50 coated panels the CED material is analyzed and is replenished with binder and pigment paste. The meq acid analyses show the change in the acid content as a function of the replenishment rate.

Acid expulsion 0%=doubling of the meq acid value after 1 turnover

Acid expulsion 100=constant meq acid value

Figure 1:
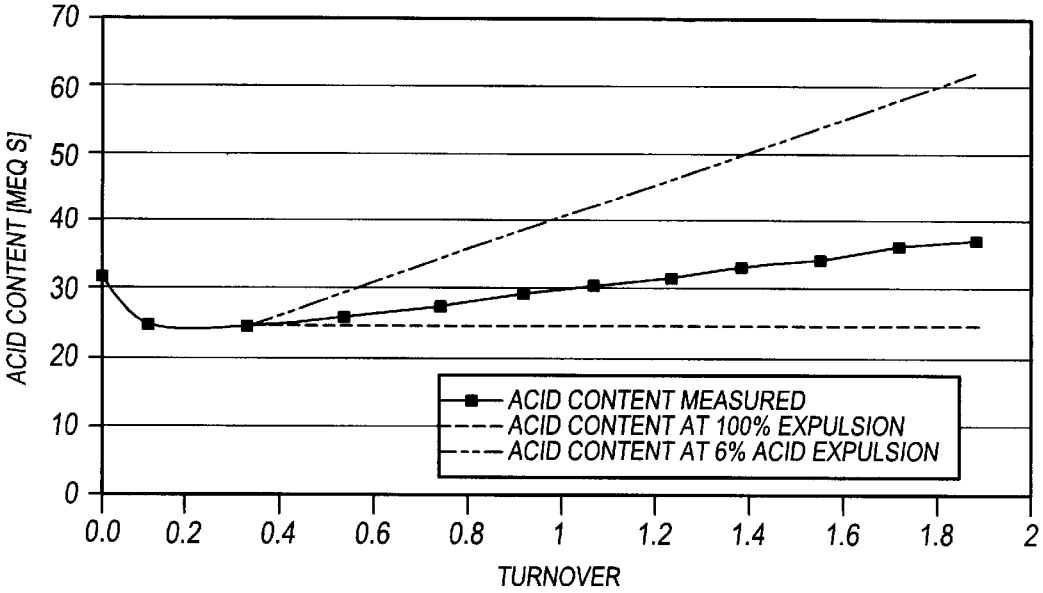
FIG. 1 shows a plot of the meq acid content against the "turnover" of the CED bath (a turnover of 1 denotes complete replenishment of the bath). Also indicated is the change in acid content of 0 and 100% acid expulsion.
Figure 2:
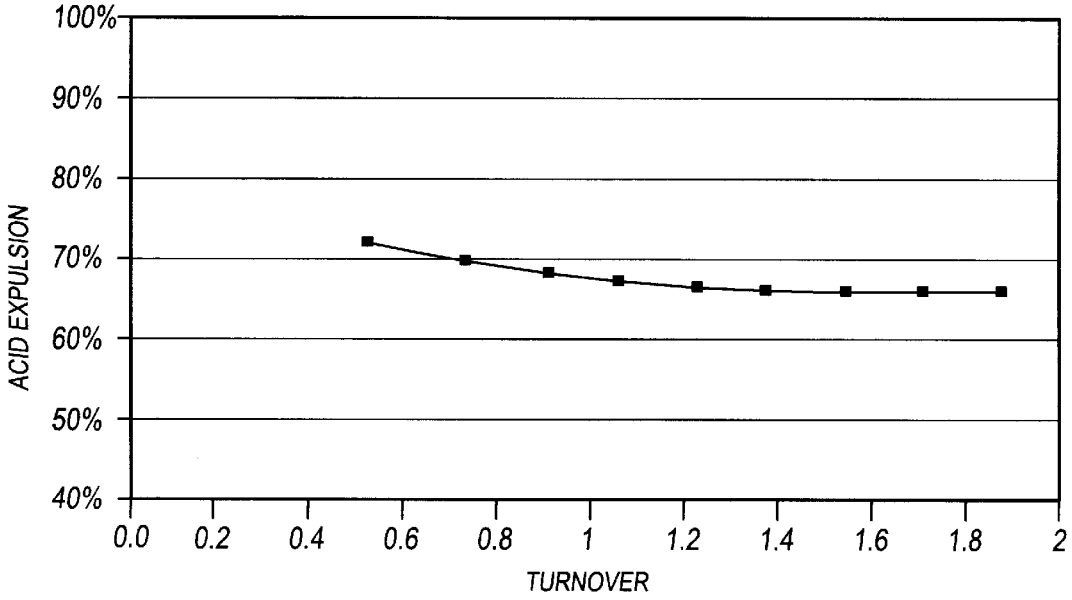

FIG. 2 shows the acid expulsion based on the meq acid value after 0.3 turnover (the 0.3 turnover base was chosen since at this point in time the establishment of equilibrium between bath and ultrafiltrate is virtually complete).

Acid expulsion=(dtrunover×meqSo+meqSo−meqSt)/dtrunover×meqSo where:

dturnover=actual turnover=0.3 meqSo=meq acid content after 0.3 turnover (base value, see above)

meqSt=actual meq acid content

Summary: The breakdown rate or expulsion rate, after relatively high levels to start with (establishment of equilibrium), settles down to a constant level of 65–70% over the period of the experiment. The balance of 100% acid expulsion must be achieved by means of an additional measure, such as electrodialysis, for example.

What is claimed is:

1. A method of removing an acid liberated in a cathodic electrodepositon coating process, the method comprising providing an electrodeposition bath having a cathode and an anode, wherein the anode comprises a substrate and an oxide coating layer of an oxide selected from the group consisting of tin oxide, a mixture of tin oxide and ruthenium oxide, a mixture of tin oxide and iridium oxide and mixtures thereof, and breaking down the acid by oxidation at the anode, wherein the acid is selected from the group consisting of formic acid, acetic acid, lactic acid, dimethylolpropionic aid and mixtures thereof.

2. The method as claimed in claim 1, wherein said oxidation takes place in an anolyte circuit.

3. The method of claim 1, wherein the anode and cathode are not separated from one another by a membrane in the electrodeposition bath and wherein in addition to the anodic oxidation of the acid, a separation of acid takes place with the aid of a membrane method.

4. The method as claimed in claim 3, wherein the membrane method comprises an ultrafiltration circuit present in the electrodeposition coating bath.

5. The method of claim 3, wherein the membrane method is selected from the group consisting of dialysis, electrodialysis, osmosis, reverse osmosis, and one or more ultrafiltrations.

6. The method of claim 1, wherein the electrodeposition coating bath employs one or more binders comprising a synthetic resin having cationic groups.

7. The method of claim 6, wherein the synthetic resin comprises the protonated reaction product of one or more epoxide-functional synthetic resin and one or more amines.

8. The method of claim 1, wherein the substrate of the anode comprises metal or conductive plastic.

9. The method of claim 8, wherein the substrate of the anode comprises a metal selected from the group consisting of titanium, tantalum, niobium, mixtures thereof and alloys of said metals.

10. The method of claim 9, wherein the substrate of the anode comprises a titanium alloy comprising 1–15% by weight molybdenum.

11. A method according to claim 1, wherein the efficiency of the anodic oxidation of the acid is from 93% to 99%.

12. A method of removing an acid liberated in a cathodic electrodeposition coating process, the method comprising providing an electrodepositon bath having a cathode and an anode, wherein the anode comprises a substrate and an oxide coating layer of an oxide selected from the group consisting of tin oxide, a mixture of tin oxide and ruthenium oxide, a mixture of tin oxide and iridium oxide, and mixtures thereof, and breaking down the acid by oxidation at the anode.

13. A method of removing an acid liberated in a cathodic electrodeposition coating process, the method comprising:

providing an electrodeposition bath having a cathode and an anode wherein the anode comprises a substrate and on the substrate an oxide coating layer of an oxide selected from the group consisting of tin oxide, a mixture of tin oxide and ruthenium oxide, a mixture of tin oxide and iridium oxide, and mixtures thereof, and breaking down the acid by oxidation at the anode, wherein the efficiency of anodic oxidation of the acid is greater than 87%.

14. A method of removing an acid liberated in a cathodic electrodeposition coating process, the method comprising:

providing an electrodeposition bath having a cathode and an anode wherein the anode comprises a substrate and on the substrate an oxide coating layer comprising tin oxide, and breaking down the acid by oxidation at the anode.

15. A method according to claim 14, wherein the efficiency of the anodic oxidation of the acid is greater than 87%.

* * * * *